US005236610A

United States Patent [19]

Perez et al.

[11] Patent Number: 5,236,610

[45] Date of Patent: Aug. 17, 1993

[54] STABLE HIGH TEMPERATURE LIQUID LUBRICANT BLENDS AND ANTIOXIDANT ADDITIVES FOR USE THEREWITH

[75] Inventors: Joseph M. Perez, Germantown, Md.; Yuming Zhang, Lansdale, Pa.; Chia-soon Ku, Cupertino, Calif.; Stephen M. Hsu, Darnstown, Md.

[73] Assignee: The United States of America as represented by the Secretary of the Commerce, Washington, D.C.

[21] Appl. No.: 827,946

[22] Filed: Feb. 3, 1992

[51] Int. Cl.[5] ..... C10M 111/02

[52] U.S. Cl. ..... 252/56 S; 252/46.3; 252/50; 252/52 R; 252/49.8; 252/56 R; 252/57

[58] Field of Search ..... 252/32.5, 49.8, 50, 252/56 R, 56 S, 46.3, 52 R; 585/26

[56] References Cited

U.S. PATENT DOCUMENTS

| | | | |
|---|---|---|---|
| 4,313,840 | 2/1982 | Komatsuzaki | 252/77 |
| 4,604,491 | 8/1986 | Dressler et al. | 585/25 |
| 4,735,146 | 4/1988 | Wallace | 252/18 |
| 4,857,220 | 8/1989 | Hashimoto | 252/56 R |
| 4,879,054 | 11/1989 | Waynick | 252/41 |
| 5,032,309 | 7/1991 | Miles | 252/77 |
| 5,136,116 | 8/1992 | Ohhazama et al. | 252/56 R |

OTHER PUBLICATIONS

CA 113 (6):43704b, Japanese Patent No. 01225697 A2 Sep. 8, 1989 Abstract.

*Primary Examiner*—Margaret Medley
*Attorney, Agent, or Firm*—Foley & Lardner

[57] ABSTRACT

An antioxidant additive for an engine or propulsion system lubricant subjected to high temperatures which includes a high molecular weight substituted phenolic carboxylic acid tetraester of pentaerythritol. A lubricant blend which is capable of solubilizing the antioxidant additive and includes a polyolester, a phosphate ester and at least one of a polyalphaolefin and an alkylated naphthalene.

17 Claims, 5 Drawing Sheets

STABLE HIGH TEMPERATURE LIQUID LUBRICANT BLENDS AND ANTIOXIDANT ADDITIVES FOR USE THEREWITH

BACKGROUND OF THE INVENTION

The present invention relates to a liquid composition which can be utilized as a base stock blend for high temperature lubricants and to a solid antioxidant additive solubilized for high temperature lubricants. In particular, the composition includes a polyolester, a phosphate ester and a synthetic hydrocarbon and the antioxidant comprises a high molecular weight polyphenol ester.

Recent advances in the field of engines and propulsion systems has led to a need for lubricants that can withstand temperatures exceeding 200° C. for a long period of time and temperatures exceeding 375° C.–400° C. for a short duration (e.g. 10–15 minutes). For example, the advanced engine concepts such as adiabatic or low heat rejection diesel engines have much higher combustion temperatures than conventional engines, resulting in maximum top ring temperatures of 375° C.–400° C. in the piston, ring and liner elements of the engine.

Known lubricants subjected to such a high temperature environment suffer from severe and rapid thermal and oxidative deterioration. Oxidation of a lubricant produces reaction products which eventually form deposits that are detrimental to oil consumption and engine emissions.

Antioxidants typically are added to lubricants to combat oxidation. Conventional mixtures of antioxidants and lubricant base stocks, however, are thermally unstable at the higher temperatures generated in the newer engine and propulsion system designs. That is, conventional antioxidants tend to decompose and/or evaporate at high temperatures and, thus, do not provide any protection of the lubricant. Moreover, if the molecular weight of the antioxidant is increased or its molecular structure changed to improve its thermal stability, the solubility of the antioxidant in conventional mineral oil/polyalphaolefin oil lubricants decreases drastically, often to the extent of becoming insoluble.

SUMMARY OF THE INVENTION

It is therefore an object of the present invention to provide an antioxidant additive for lubricants which has a relatively low volatility at high temperatures and effectively minimizes oxidation and the formation of harmful deposits.

A further object of the present invention is to provide a lubricant fluid which is capable of solubilizing an antioxidant having improved thermal stability and any thermo-oxidation products that may be produced.

In accomplishing the foregoing objects there is provided according to the present invention an antioxidant additive comprising a polyphenol ester having a structure represented by the following formula:

Formula A

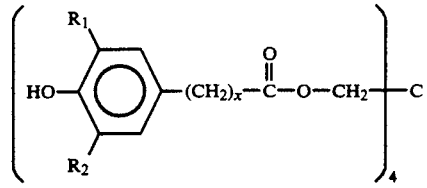

wherein $R_1$ and $R_2$ can be the same or different and are each individually a straight-chained or branched alkyl group, an aryl group, or an arylalkyl group and X is an integer from 2 to 6, inclusive. The polyphenol ester antioxidant can be utilized in a lubricant mixture either as the only antioxidant or as a component of an additive package that includes other antioxidants.

There also is provided according to the present invention a lubricant blend comprising a polyolester, a phosphate ester (ATP) and at least one synthetic hydrocarbon selected from the group consisting of a polyalphaolefin (PAO) and an alkylated naphthalene (AKZ).

An especially advantageous feature of the present invention is a lubricant mixture which includes the above described polyphenol ester antioxidant and the lubricant blend.

Further objects, features and advantages of the present invention will become apparent from the detailed description of preferred embodiments that follows.

BRIEF DESCRIPTION OF THE DRAWINGS

Certain characteristics of the present invention will be descried in detail below with reference to the drawing, wherein.

DETAILED DESCRIPTION OF THE PREFERRED EMBODIMENTS

Figure 1:
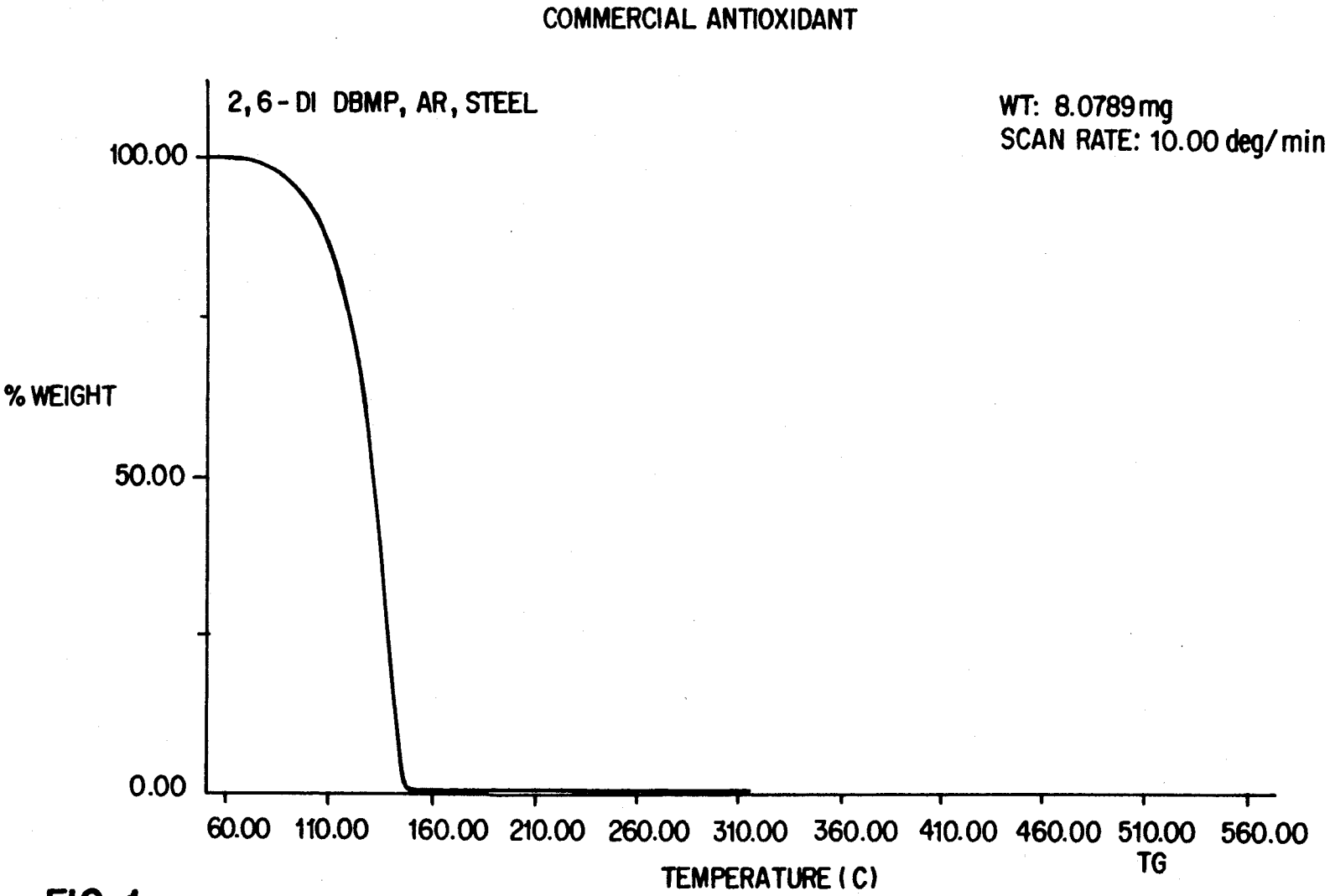
FIG. 1 is a graph illustrating the volatility of a first conventional antioxidant.

The principal antioxidant additive of the present invention is a substituted phenolic carboxylic acid tetraester of pentaerythritol, hereinafter referred to as polyphenol ester, having a structure represented by the following formula A:

Formula A

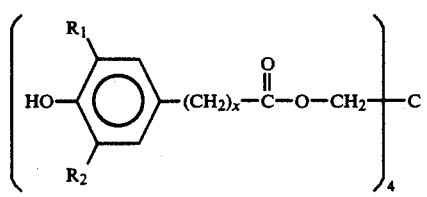

$R_1$ and $R_2$ of formula A can be the same or different and are each individually a straight-chained or branched alkyl group preferably having 1 to 8, preferably 2 to 6, carbon atoms, an aryl group or an arylalkyl group. Particularly preferred for both $R_1$ and $R_2$ are t-butyl groups. X is an integer ranging from 2 to 6, inclusive. In a preferred embodiment X is 2. $R_1$, $R_2$ and X are selected so that the molecular weight of the polyphenol ester does not become so great as to adversely affect the solubility of the antioxidant in the lubricant base stock.

One or more polyphenol esters encompassed by formula A can form part of an additive package in conjunction with one or more conventional antioxidant, corrosion inhibitor, antiwear and surface deactivator additives. Particularly advantageous for use with the polyphenol ester are polyaryl amine antioxidants and sulfur-containing antioxidants. Preferred polyaryl amines are a phenyl naphthylamine having a structure represented by the following formula B:

Formula B

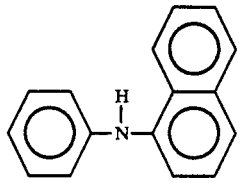

and a diphenylamine having a structure represented by the following formula C:

Formula C

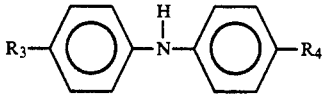

Particularly advantageous are phenyl-α-naphthylamine and p,p'-dioctyldiphenylamine. The diphenylamine also acts as a corrosion inhibitor.

A preferred sulfur-containing antioxidant is a methylene bis(dialkyl-dithiocarbamate) or methylene bis(diaryl-dithiocarbamate) having a structure represented by the following formula D:

Formula D

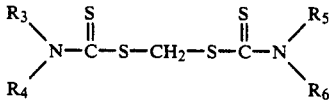

Particularly advantageous is methylene bis(dibutyldithiocarbamate. Methylene bis(dialkyl-dithiocarbamate) or methylene bis(diaryl-dithiocarbamate) also acts as an antiwear agent.

Other conventional antioxidants that can be mixed with the polyphenol ester include a 2,6-dialkyl-p-cresol having a structure represented by the following formula E or a bisphenol derivative thereof, and a high molecular weight tris-substituted phosphite having a structure represented by the following formula F:

Formula E

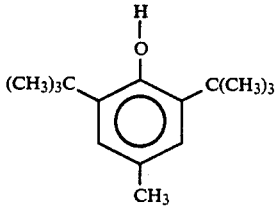

-continued

Formula F

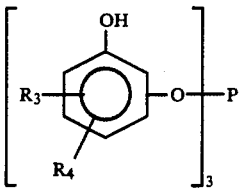

Particularly advantageous are 2,2'-methylenebis(2,6-di-t-butylphenol), tris-(3-hydroxy-4,6-di-t-butylphenyl) phosphite and tris-(3-hydroxy-hexadecylphenyl) phosphite. The high molecular weight phosphite also acts as a corrosion inhibitor.

A useful antiwear additive is a trialkyl/aryl phosphate additive corresponding to the following formula G:

Formula G

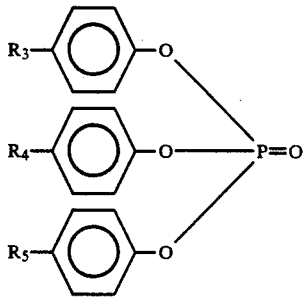

Tricresyl phosphate is particularly advantageous.

$R_3$, $R_4$, $R_5$ and $R_6$ of formulas B through G can be the same or different and are each individually a hydrogen atom, an alkyl group or an aryl group.

There can also be included with the polyphenol ester a zinc dialkyl, diaryl or arylalkyl dithiophosphate, a metallic naphthenate, such as lead, copper or iron naphthenates, and an ashless succinimide type dispersant. In addition, low medium or high ash calcium, boron or magnesium salicylates, a calcium sulfonate detergent and overbased calcium phenates can be included.

The polyphenol ester of formula A is added to a lubricant base stock in an amount of up to about 5 weight percent, preferably about 1-3 weight percent, relative to the total weight of the overall lubricant composition. The preferred amounts for other additives which may be included with the polyphenol ester is as follows:

about 0-2 wt.% phenyl naphthylamine (formula B);
about 0-2 wt.% diphenylamine (formula C);
about 0-2 wt.% methylene bis(dialkyl-dithiocarbamate) (formula D);
about 0-2 wt.% 2,6-dialkyl-p-cresol or bisphenol derivative thereof (formula E);
about 0-2 wt.% high molecular weight phosphite (formula F);
about 0-5 wt.% trialkyl/aryl phosphate (formula G);
about 0-2 wt.% zinc dialkyl, diaryl or arylalkyl dithiophosphate;
about 0-1000 ppm metallic naphthenate; and
about 0-15 wt.% ashless dispersant.

Figure 2:
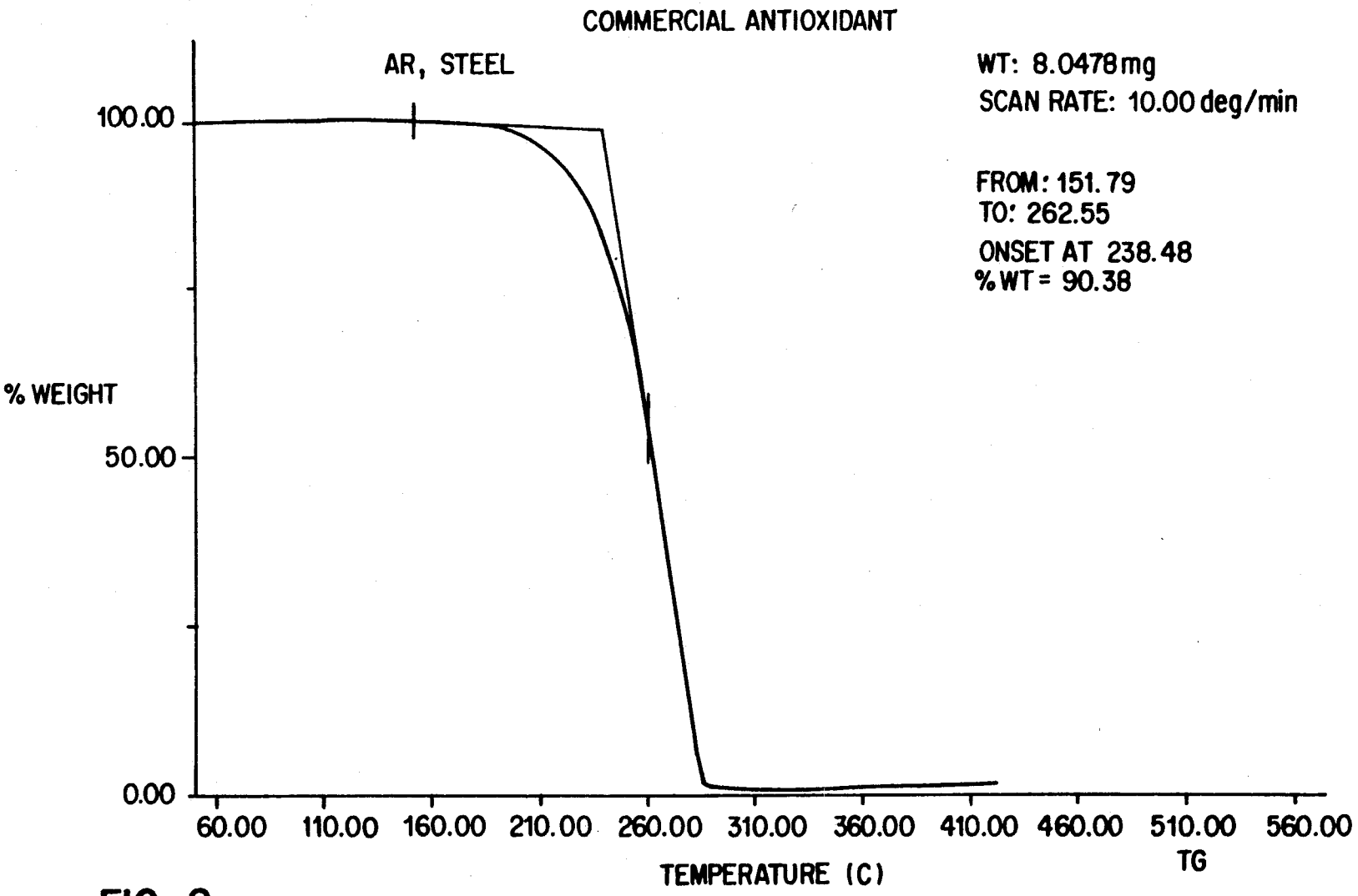
FIG. 2 is a graph illustrating the volatility of a second conventional antioxidant.
Figure 3:
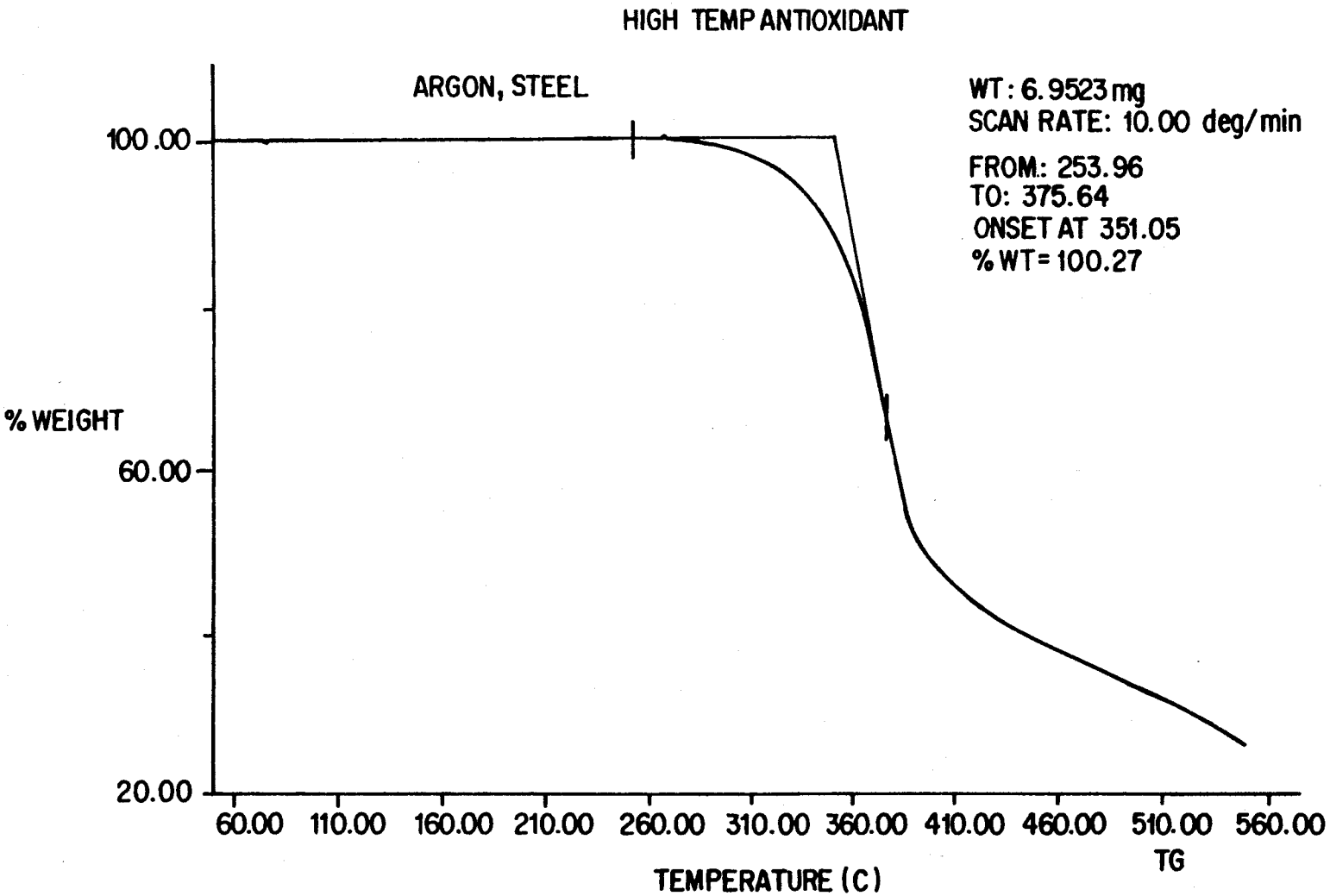
FIG. 3 is a graph illustrating the volatility of an embodiment of the antioxidant according to the present invention.

The superior low volatility of the polyphenol ester antioxidant of Formula A according to the present invention can be seen from a comparison of FIGS. 1 and 2, which depict the vaporization curves of conventional, commercially available antioxidants, with FIG.

3, which depicts the vaporization curve of the polyphenol antioxidant of Formula A. As can be seen from the graphs, the onset of thermal decomposition (determined from the intersection of the baseline and a tangent to the slope of vaporization curve) of the polyphenol antioxidant of Formula A does not occur until approximately 350° C., which temperature is significantly higher than the highest temperatures withstood by the conventional antioxidants.

The procedure used to compare volatility has been described in Hsu, et al., "Thermogravimetric Analysis of Lubricants," Society of Automotive Engineers (SAE) Technical Paper No. 831682 (1982); Perez, "High Temperature Liquid Lubricants," USDOE Publication Conf 9008151; and Hsu, "A Critical Assessment of Liquid Lubricant Technology for Heavy Duty Diesel Engines," USDOE Publication Conf 9008151. The method involves the use of a commercial thermogravimetric analyzer (Perkin-Elmer TGS-2) in which the sample is subjected to a programmed temperature rate of 10° per minute from room temperature to 600° C. The sample is under an inert argon atmosphere. A 0.7 to 0.8 milligram sample is placed in a gold sampling pan and weighed. The weight is monitored using the thermogravimetric analysis microbalance, and the weight lost upon heating is continuously recorded. A plot of the weight remaining, or the weight lost, versus temperature is obtained. Two modifications are a) to use an oxygen or air atmosphere to observe the difference in volatility due to oxidation of the sample and b) to use a metal pan, or metal insert in the gold pan, to observe the oxidation catalytic effects of the iron metal surfaces. Modification b) is usually run under oxygen with steel inserts in the gold pan. Aluminum or ceramic inserts can also be used.

It is evident from the decrease in the amount of liquid antioxidant present that the commercially available antioxidants volatilize at much lower temperatures than the polyphenol ester antioxidant of the present invention.

The lubricant base stock blend according to the present invention comprises a polyolester, a phosphate ester and a synthetic hydrocarbon. The relative proportions of the individual constituents are selected so that the constituents are mutually miscible. The preferred amounts of the constituents are about 25–65 weight percent polyolester, about 5–15 weight percent phosphate ester and about 25–65 weight percent synthetic hydrocarbon, relative to the total weight of the lubricant.

The preferred polyolester utilized in the present invention is a trimethylolpropane ester (TMP) of carboxylic acids having a structure represented by the following formula H:

Formula H

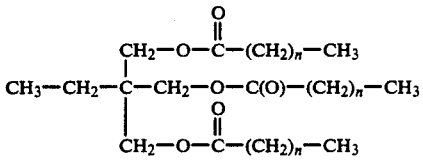

wherein n is an integer ranging from 5 to 9, inclusive. Other functionally equivalent trimethylolpropane esters may also be employed including trimethylolpropane pelargonate (Stauffer Chemical Company "Base Stock 700"), trimethylolpropane trinonoate (Stauffer Chemical Company "Base Stock 900"), and polyol esters (Mobil Ester P-43, or Hatco Corp. 2939). The polyolester preferably has a pour point of about −40° C. and a viscosity of about 4.4 to 6.0 centistokes at 100° C. and about 20 to 24 centistokes at 40° C.

The phosphate ester of the lubricant base stock is a triaryl/alkyl phosphate ester according to formula G or other functionally equivalent phosphate esters having similar molecular weights as the triaryl/alkyl phosphate ester and low volatility, excellent thermal and oxidative stability and good lubrication properties. The alkyl groups of the trialkyl phosphate ester advantageously contain about 1 to 4 carbon atoms. The phosphate ester preferably has a pour point of about −15° to −18° C. and a viscosity of about 4 to 5 centistokes at 100° C. and about 32 to 39 centistokes at 40° C. A preferred phosphate ester is a butylated triphenyl phosphate mixture essentially composed of t-butylphenyl diphenyl phosphate (40–45%) CAS Registry No. 56803-37-3, bis(t-butylphenyl) phenyl phosphate (20–25%) CAS Registry No. 65652-41-7, and triphenyl phosphate (25–30%) CAS Registry No. 115-86-6 (Akzo "FYRQUEL GT"). Other suitable phosphates include cresyl diphenyl phosphate, tri-n-alkyl phosphates such as tri-n-propyl and tri-n-octyl phosphates, trixylyl phosphate, and tetrabutylphenyl diphenyl phosphate. Tricresyl phosphate may also be used, but is considered less preferred because of the possibility it may react under extreme conditions with polyol esters to produce toxic byproducts.

The synthetic hydrocarbon component is a polyalphaolefin and/or an alkylated naphthalene. The polyalphaolefin is produced by the polymerization or reaction of alphaolefins with other synthetic or natural molecules and has a structure represented by the following formula I:

Formula I

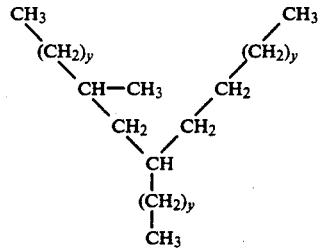

wherein y is an integer ranging from 2 to 15, preferably 3 to 8, inclusive. Preferably, the viscosity of the polyalphaolefin is about 2 to 110 centistokes at 100° C. and 5 to 1400 centistokes at 40° C., and the pour point is about −40° C. The alkylated naphthalene has a preferred viscosity of about 5 to 25 centistokes at 40° C. and a structure which is represented by the following formula J:

Formula J

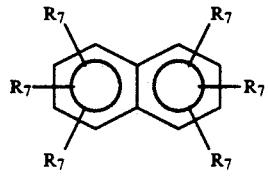

wherein $R_7$ can be the same or different and is a hydrogen atom or an alkyl group.

Figure 4:
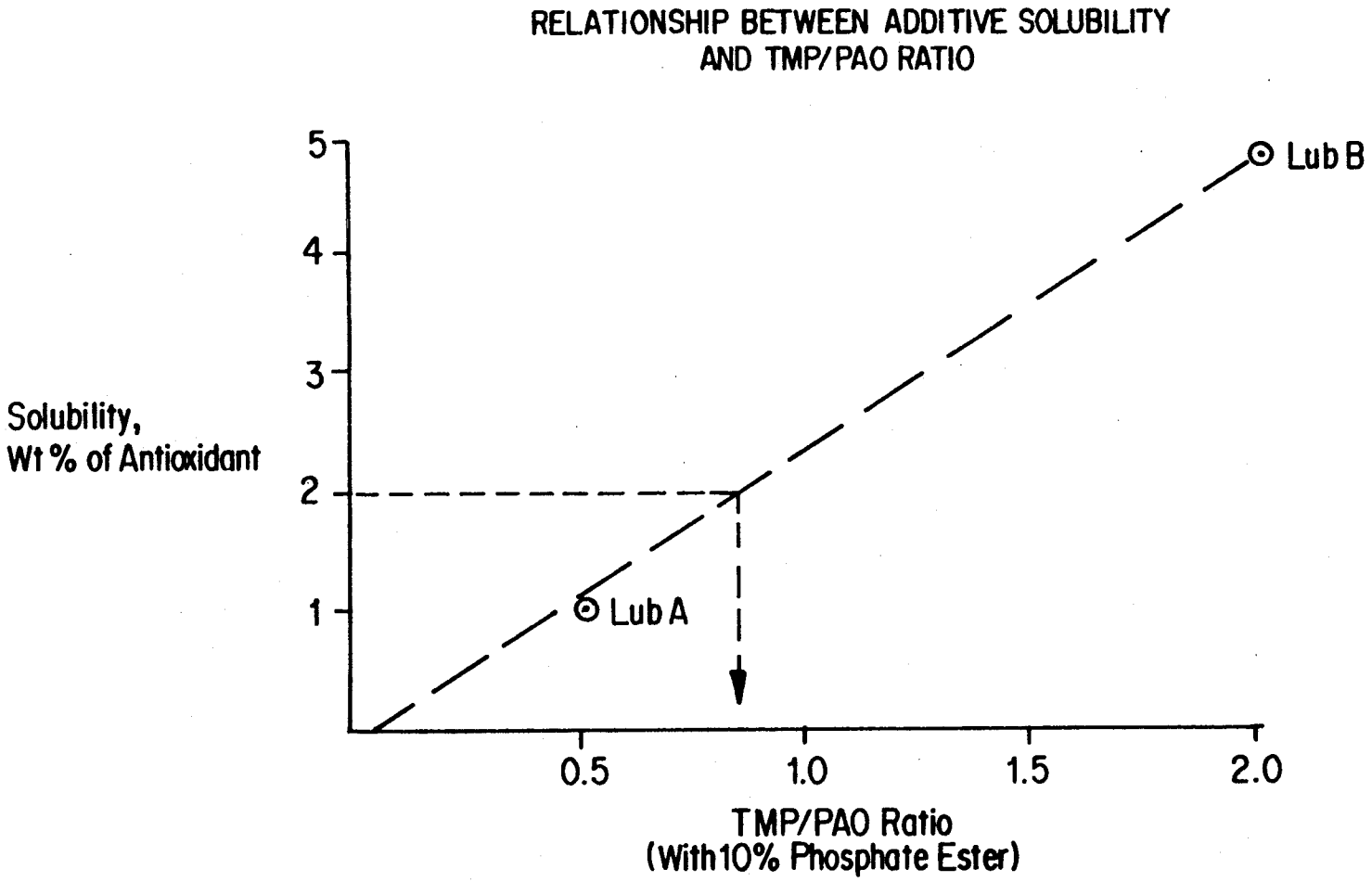
FIG. 4 is a graph illustrating the relationship between antioxidant solubility and base stock composition.

An important advantage of the lubricant base stock blend is its ability to dissolve high molecular weight, high temperature antioxidants, especially the polyphenol ester antioxidant described in the present invention. Specifically, at least about 2 weight percent of the polyphenol ester is soluble in the lubricant blend, with certain blend ratios able to solubilize up to more than about 7 weight percent of the polyphenol ester. The solubility of the polyphenol ester increases as the polyol ester proportion increases, and as can be seen from the solubility chart depicted in FIG. 4, 5 wt.% solubility is achieved at a polyol ester/polyalphaolefin/phosphate ester blend of 60:30:10. Other blends that may hold 5 weight percent of the polyphenol alcohol are those which maintain the ester content and vary only the type of hydrocarbon. For example, blends in which some or all of the polyalphaolefin was replaced with synthetic alkylates, e.g. polyalkyl naphthalenes. See also Blends 7 and 8 in the following Table 1.

In addition, if the lubricant blend does undergo oxidation and thermal degradation at extreme high temperatures, the blend produces minimal deposits. The development of substantial deposits is avoided by the lubricant blend since the oxidation and thermal reaction products (1) are volatilized which produces gases that are burned cleanly in the combustion process, (2) produce chemical species that are beneficial to the lubrication of the engine or propulsion system parts, and/or (3) solubilize in the lubricant blend.

The lubricant blend also has low volatility, good friction and wear characteristics and is compatible with ceramic and metallic surfaces. The 50:40:10 TMP:PAO:ATP base stock blend has a viscosity of 8–9 centistokes at 100° C. By modifying the three components of the base stock blend, the viscosity can range from 2.5 to 17 centistokes at 100° C. These viscosity values are determined by extrapolation using ASTM Test Method D 341-77, "Viscosity-Temperature Charts for Liquid Petroleum Products" and the typical viscosities of the component fluids. The PAO has the greatest effect on the final blend viscosity since it can be obtained over a viscosity range of 1.7 to 100 centistokes at 100° C.

It is presumed that the presence of both polar molecules, i.e., the polyolester component, and high molecular weight non-polar hydrocarbon molecules, i.e., the polyalphaolefin component, contributes advantageously to the solubilization of the antioxidant additive package and any reaction products. The synthetic hydrocarbon component serves to control the viscosity of the blend at lower temperatures and promotes the maintenance at higher temperatures of a liquid film on the engine or propulsion system surfaces.

Table 1 lists a few embodiments of the lubricant blend according to the present invention along with their viscosities and ability to solubilize the polyphenol ester antioxidant additive. Particularly preferred is Blend 3, which is a 50:40:10 polyol ester(TMP):polyalphaolefin (PAO):phosphate ester(ATP) blend. The polyolester in all blends in Table 1 is trimethylolpropane pelargonate (Stauffer Chemical Co. "Base Stock 700" or "Hatco 2939"). The phosphate ester is Akzo "FYRQUEL GT" or "FYRQUEL GT150". The polyalphaolefin in the preferred Blend 3 is commercially available from Mobil Oil Co. under the trade designation "SHF 401". Viscosities in the table are extrapolated using ASTM blending charts and the 100° C. literature values for the base stock ingredients without additives. The measured viscosity of a fully formulated oil using the Blend 3 base stock with additives is 12.1 centistokes at 100° C. and 85.4 centistokes at 40° C. (Viscosity Index = 130).

Table 2 lists a few embodiments according to the present invention of the mixture of the lubricant blend, polyphenol ester antioxidant and other additives. The following designations are used in the Table:

| | |
|---|---|
| AOP-1: | tetrakis[methylene(3,5-di-tert-butyl-4-hydroxyhydrocinnamate)] methane (Ciba-Geigy Corp. "IRGANOX 1010"), CAS Registry No. 6683-19-8, [Formula A]. |
| AOA-1: | octylated diphenylamine mixture (R. T. Vanderbilt Co., Inc. "VANLUBE 81"), CAS Registry No. 68411-46-1. |
| AOT-1: | methylene bis(dibutyl-dithiocarbamate (R. T. Vanderbilt "VANLUBE 7723"), [ashless antioxidant and extreme pressure (EP) antiwear lubricant additive]. |
| CI-1: | amine phosphite corrosion inhibitor (Ciba-Geigy "IRGALUBE 349") [surface active inhibitor to deactivate metal surfaces and inhibit catalytic decomposition of fluid]. |
| SAI: | 2-mercaptobenzothiazole (R. T. Vanderbilt Co. "ROKON") or polymerized trimethyldihydroquinoline (Uniroyal Chemical Co. "NAUGAURD Q" or "Super Q") [surface active inhibitor]. |
| AOP-136: | tris-(3-hydroxy-4,6-di-tert-butylphenyl) phosphite (Indspec Chemical Co., DTB Phosphite) [stabilizer and antioxidant]. |
| AOP-139: | tris-3-hydroxyhexadecylphenyl) phosphite (Indspec Chemical Co.). |
| JMP-33-1: | 51:39:10 blend of TMP:AKZ:ATP in which AKZ designates an alkylated naphthalene (U.S. Pat. No. 4,604,491) used in place of polyalphaolefin. |
| JMP-184-1: | 31:13:52:4.5 PAO SHF61:SHF1001:TMP:ATP blend where the phosphate ester ATP is "FYRQUEL GT-150". |
| JMP-184-1A: | same as JMP-184-1 plus 1.0 wt % octylated diphenylamine mixture and 1.9 wt % methylene bis(dibutyl-dithiocarbamate). |
| JMP-184-1B: | same as JMP-184-1 plus 2.0 wt % tetrakis-[methylene(3,5-di-tert-butyl-4-hydroxyhydrocinnamate)] methane. |
| COT: | 2,5-dimercapto-1,3,4-thiadiazole derivative ("CUVAN 484"), [copper corrosion inhibitor, metal deactivator and hydrogen sulfide suppressor]. |

Table 3 compares the thermal characteristics of the polyphenol ester of the present invention and conventional antioxidant additives and illustrates the synergistic effects of using the polyphenol ester in conjunction with conventional antioxidant additives. Thermogravimetric analysis data for Table 3 was obtained as described above (Hsu op. cit.). As shown in Table 3, when the polyphenol ester is included in the lubricant blend, the highest TGA onset temperature occurs, which signifies that the lubricant components remain non-volatile at higher temperatures.

Figure 5A:
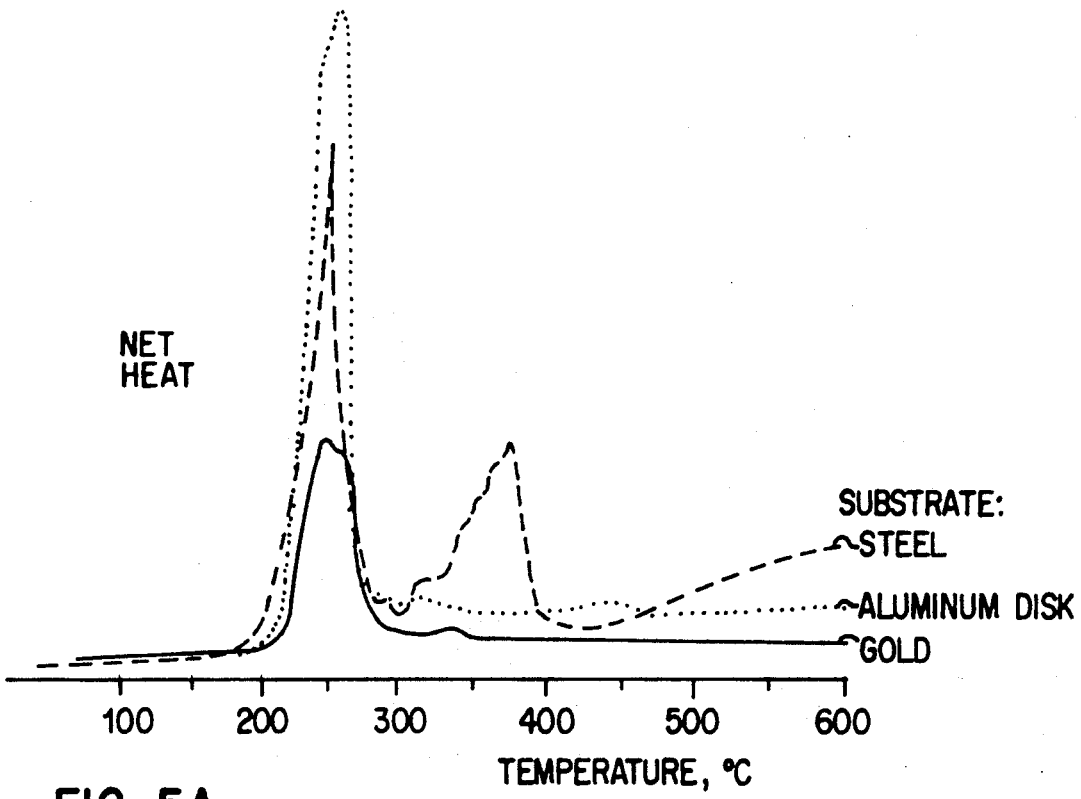
FIGS. 5A and 5B are graphs depicting the results of differential scanning calorimetry oxidation curves for the lubricant base stock materials of the invention.
Figure 5B:
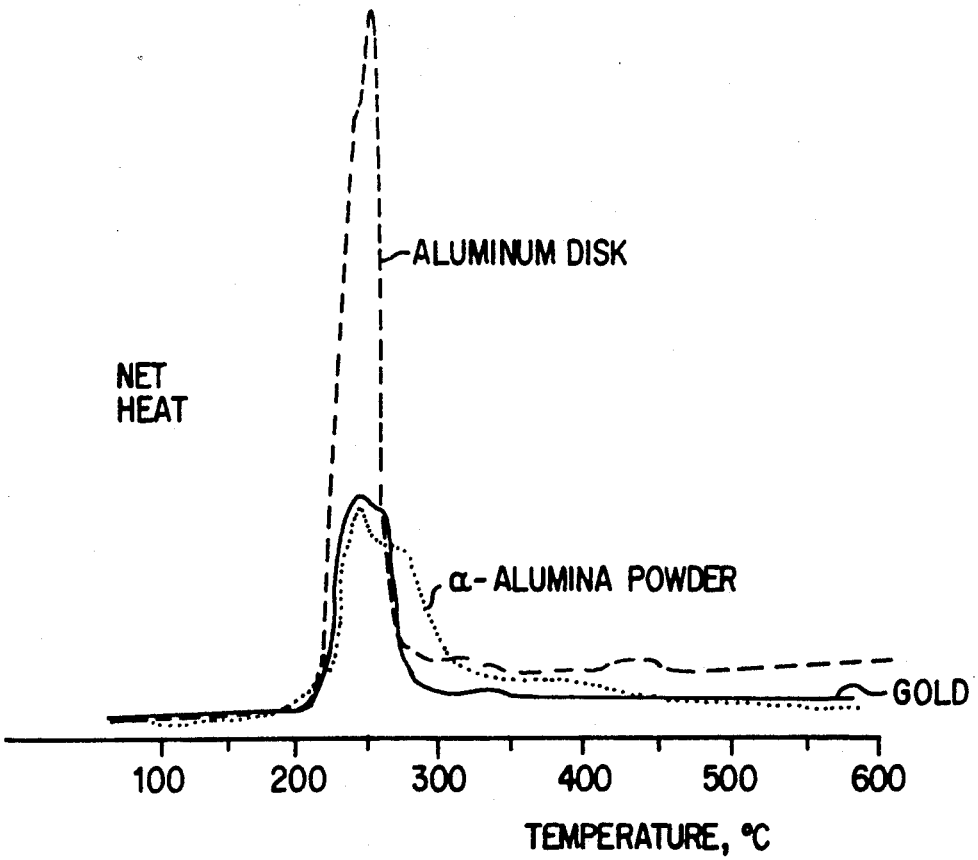

FIGS. 5A and 5B show the results of pressurized differential scanning calorimetric tests of the polyalphaolefin and the polyolester, respectively, used as base stock components in the examples of the present invention. As can be seen from the figures, the lubricant base stock components undergo oxidation and thermal decomposition in the high temperature thermal analysis tests and break down cleanly, leaving minimal deposits at high temperature. Possible catalytic effects on decomposition are indicated by a comparison of the curves obtained in tests conducted with pans of different substrate materials, i.e. steel (shown as a dashed line), aluminum (shown as a dotted line), and gold (shown as a solid line).

Two differential scanning calorimetry methods were used to study oxidation stability. The first was an isothermal method based on the general procedures described in Walker et al., "Characterization of Oils by Differential Scanning Calorimetry," SAE Technical Paper No. 801383 (1980) and Hsu et al., "Evaluation of Automotive Crankcase Lubricants by Differential Scanning Calorimetry," SAE Technical Paper No. 821252 (1982). The second is a programmed temperature method based on Perez et al., "Diesel Deposit Forming Tendencies—Microanalysis Methods," SAE Technical Paper No. 910750 (1991). Onset temperatures are obtained from the intersection of the baseline and a tangent to the slope of the primary oxidation peak. Test conditions used in both methods include a) accurately weighing 0.6 to 1.0 milligram sample of test oil into a steel, gold or aluminum sample pan; b) sealing the pan with a lid containing a small vent hole; c) placing the sample pan and a reference pan which contains no sample, in the test chamber of the differential scanning calorimeter, and sealing and pressurizing the unit with air or oxygen at 150 or 550 psig, depending on the purpose of the test, while maintaining a flow of about 40, 60 or 120 cc per minute of gas through the pressurized chamber. The main difference between the isothermal and programmed temperature test procedures is the temperature which is used. In the isothermal tests, the temperature is preselected. To start the test, the unit is ramped up to the preselected temperature and then maintained constant at the preselected temperature. The time it takes for rapid oxidation to occur is used as an indication of the stability of the fluid. This time period is usually referred to as the oxidation induction time or period. The test is usually repeated at more than one isothermal temperature.

Onset temperatures for blends with and without polyphenol ester, phenyl naphthylamine and 2,5-dimercapto-1,3,4-thiadiazole additives are compiled in Table 4. Blend 3 was used as the base stock for all the samples. The data in Table 4 was obtained using the programmed temperature procedure at 550 psig, 120 cc gas per minute, and a programmed temperature rate of 10° C. per minute. The data shows that addition of the polyphenol ester to a lubricant mixture which also includes a conventional antioxidant additive increases the oxidation onset temperature.

TABLE 1

| BLEND DESIGNATION | BASE STOCK FORMULATIONS COMPONENT CONCENTRATION, WT % Polyolester | Phosphate ester | Polyalpha-olefin | Polyalkyl naphthalene | Viscosity* | Solubilized Polyphenol Ester Wt. % |
|---|---|---|---|---|---|---|
| BLEND 1 | 30 | 10 | 60 | — | 19 | 3% |
| BLEND 2 | 60 | 10 | 30 | — | 7.0 | 5% |
| BLEND 3 | 50 | 10 | 40 | — | 8.0 | 2% |
| BLEND 4 | 43.7 | 10.2 | 46.0 | — | 17 | 2% |
| BLEND 5 | 41.7 | 10.7 | 47.5 | — | 15 | 2% |
| BLEND 6 | 44.0 | 5.1 | 50.9 | — | 5.6 | 2% |
| BLEND 7 | 51.4 | 9.6 | — | 38.9 | 7.0 | 2% |
| BLEND 8 | 46.4 | 10.9 | 27.7 | 15.2 | 5.7 | 2% |

*extrapolated viscosities at 100° C. using ASTM blending charts and literature values of base stock fluids without additives.

TABLE 2

| MIXTURE DESIGNATION | LUBRICANT MIXTURES BASE STOCK COMPONENT CONCENTRATION, WT % RELATIVE TO TOTAL WEIGHT OF BASE STOCK Polyolester | Phosphate Ester | Polyalpha-olefin | Polyalkyl Naphthalene | POLYPHENOL ESTER OF FORMULA A CONCENTRATION, WT % RELATIVE TO TOTAL WEIGHT OF LUBRICANT MIXTURE | OTHER ADDITIVES CONCENTRATION, WT % RELATIVE TO TOTAL WEIGHT OF LUBRICANT MIXTURE |
|---|---|---|---|---|---|---|
| 1 | 60 | 10 | 30 | — | 2-5 AOP-1 | — |
| 2 | 50 | 10 | 40 | — | 1 AOP-1 | — |
| 3 | 50 | 10 | 40 | — | 2 AOP-1 | — |
| 4 | 50 | 10 | 40 | — | 3.5 AOP-1 | — |
| 5 | 50 | 10 | 40 | — | 2 AOP-1 | 1-2 AOA-1 |
| 6 | 50 | 10 | 40 | — | 2 AOP-1 | 1 AOT-1 |
| 7 | 50 | 10 | 40 | — | 2 AOP-1 | 1-2 AOA 1, 1 AOT-1 |
| 8 | 50 | 10 | 40 | — | 2 AOP-1 | 1-2 APA 1, 1 AOT-1, 0.1-0.5 CI |
| 9 | | JMP 184-1 | | | 2 AOP-1 | — |
| 10 | | | | | 2 AOP-1 | 1 AOP-136(P) |
| 11 | | | | | 2 AOP-1 | 1 AOP-139(L) |
| 12 | | JMP 33-1 | | | 2 AOP-1 | — |
| 13 | | | | | 2 AOP-1 | 1 AOP-136(P) |
| 14 | | | | | 2 AOP-1 | 2 AOP-136(P) |
| 15 | | | | | 2 AOP-1 | 2 AOP-139(L) |
| 16 | | | | | 2 AOP-1 | 2 AOP-136(P) + 1 AOA-1 |
| 17 | | | | | 1 AOP-1 | 2 AOP-2 + 1 AOA-1 |

TABLE 3

| Fluids | | TGA Onset Temperature (°C.) |
|---|---|---|
| BLEND 3 | | 214 |
| BLEND 3 + 2% | Polyphenol ester of formula A | 267 |
| | Phenyl naphthylamine of formula B | 254 |
| | Diphenylamine of formula C | 245 |
| | AOT-1 | 222 |

TABLE 3-continued

| Fluids | | TGA Onset Temperature (°C.) |
|---|---|---|
| BLEND 3 + 2% polyphenol ester of formula A + 1% | Phenyl naphthylamine of formula B | 281 |
| | Diphenylamine of formula C | 276 |
| | AOT-1 | 268 |
| BLEND 3 + 2% Polyphenol ester of formula A + 0.5% COT + 1% | No additional additive | 265 |
| | Phenyl naphthylamine of formula B | 280 |
| | Diphenylamine of formula C | 273 |
| | AOT-1 | 265 |

TABLE 4

Pressurized Differential Scanning Calorimetry Results

| Samples | Sample Pan | Sample Weight (mg) | Atmosphere | T (onset) °C. |
|---|---|---|---|---|
| Blend 3 | steel | .667 | air | 199 |
| Blend 3 | gold | .636 | air | 212.5 |
| Blend 3 | steel | .680 | $O_2$ | 197.5 |
| Blend 3 + 2% A | steel | .639 | air | 208 |
| Blend 3 + 2% A | gold | .753 | air | 260 |
| Blend 3 + 2% A | steel | .652 | $O_2$ | 215 |
| Blend 3 + 2% B | steel | .755 | air | 249 |
| Blend 3 + 2% B | gold | .612 | air | 260 |
| Blend 3 + 2% A + 1% B | steel | .634 | air | 255 |
| Blend 3 + 2% A + 1% B | gold | .702 | air | 277 |
| Blend 3 + 2% A + 1% B + .5% COT | steel | .686 | air | 250 |
| Blend 3 + 2% A + 1% B + .5% COT | gold | .600 | air | 272 |

A — polyphenol ester of formula A
B — phenyl naphthylamine of formula B
COT - 2,5-dimercapto-1,3,4-thiadiazole derivative The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A liquid lubricant blend for an engine or propulsion system, comprising about 25–65 weight percent of a polyolester, about 5–15 weight percent of a phosphate ester and about 25–65 weight percent of at least one synthetic hydrocarbon selected from the group consisting of a polyalphaolefin and an alkylated naphthalene.

2. A lubricant blend according to claim 1, wherein said polyolester has a structure corresponding to the formula:

Formula H

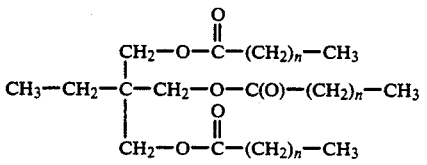

wherein n is an integer from 5 to 9, inclusive.

3. A lubricant blend according to claim 1, wherein said phosphate ester has a structure corresponding to the formula:

Formula G

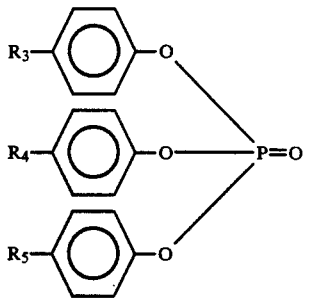

wherein $R_3$, $R_4$ and $R_5$ can be the same or different and are each individually a hydrogen atom, an alkyl group or an aryl group.

4. A lubricant blend according to claim 1, wherein said polyalphaolefin has a structure corresponding to the formula:

Formula I

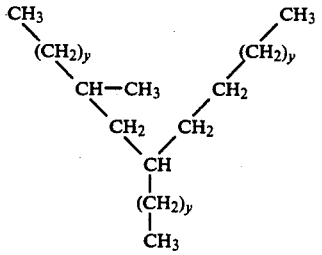

wherein y is an integer from 2 to 15, inclusive.

5. A lubricant blend according to claim 1, wherein said alkylated naphthalene has a structure corresponding to the formula:

Formula J

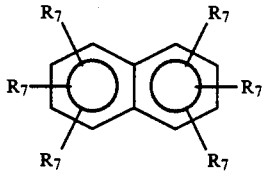

wherein $R_7$ can be the same or different and is a hydrogen atom or an alkyl group.

6. A liquid lubricant for a high temperature engine or propulsion system, comprising a mixture of about 25–65 weight percent of a polyolester, about 5–15 weight percent of a phosphate ester, about 25–65 weight percent of at least one synthetic hydrocarbon selected from the group consisting of a polyalphaolefin and an alkylated naphthalene, and an effective antioxidant amount of at least one dissolved polyphenol ester having a structure corresponding to the formula:

Formula A

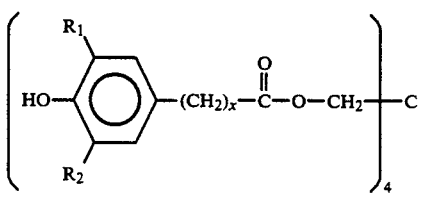

wherein $R_1$ and $R_2$ can be the same or different and are each individually a straight-chained or branched alkyl group, an aryl group or an arylalkyl group, and X is an integer from 2 to 6, inclusive, said lubricant being able to withstand a top ring temperature of 375° C. for a period of 10 minutes.

7. A lubricant according to claim 6, wherein $R_1$ and $R_2$ are each individually a straight-chained or branched alkyl group containing from 1 to 8 carbon atoms.

8. A lubricant according to claim 6, wherein both $R_1$ and $R_2$ are t-butyl groups.

9. A lubricant according to claim 6, wherein X is 2.

10. A lubricant according to claim 6, further comprising at least one compound selected from the group consisting of phenyl naphthylamine, diphenylamine, a methylene bis(dialkyl-dithiocarbamate), a methylene bis(diaryl-dithiocarbamate), a 2,6-dialkyl-p-cresol, a bisphenol of a 2,6-dialkyl-p-cresol, and a tris-substituted phosphite.

11. A lubricant according to claim 6, wherein said polyolester has a structure corresponding to the formula:

Formula H

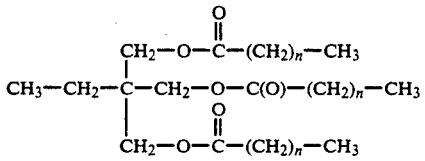

wherein n is an integer from 5 to 9, inclusive.

12. A lubricant according to claim 6, wherein said phosphate ester has a structure corresponding to the formula:

Formula G

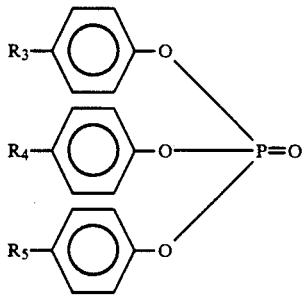

wherein $R_3$, $R_4$ and $R_5$ can be the same or different and are each individually a hydrogen atom, an alkyl group or an aryl group.

13. A lubricant according to claim 6, wherein said polyalphaolefin has a structure corresponding to the formula:

Formula I

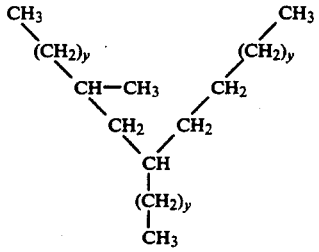

wherein y is an integer from 2 to 15, inclusive.

14. A lubricant according to claim 6, wherein said alkylated naphthalene has a structure corresponding to the formula:

Formula J

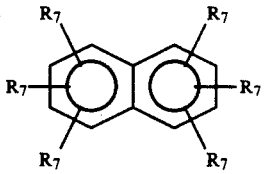

wherein $R_7$ can be the same or different and is a hydrogen atom or an alkyl group.

15. A lubricant according to claim 6, comprising a positive amount up to about 5 weight percent of said polyphenol ester, relative to the total weight of the lubricant.

16. A lubricant according to claim 15, wherein said polyphenol ester is present in amount of about 1–3 weight percent.

17. A lubricant according to claim 15, further comprising up to about 2 weight percent of at least one additive selected from the group consisting of phenyl naphthylamine, diphenylamine, a methylene bis(dialkyl-dithiocarbamate), a methylene bis(diaryl-dithiocarbamate), a 2,6-dialkyl-p-cresol, a bisphenol of a 2,6-dialkyl-p-cresol, and a tris-substituted phosphite.

* * * * *